US011189165B2

(12) United States Patent
Dowdell

(10) Patent No.: US 11,189,165 B2
(45) Date of Patent: Nov. 30, 2021

(54) WHEELCHAIR TRAFFIC SIGNAL SYSTEM

(71) Applicant: Helen M Dowdell, Columbus, GA (US)

(72) Inventor: Helen M Dowdell, Columbus, GA (US)

( * ) Notice: Subject to any disclaimer, the term of this patent is extended or adjusted under 35 U.S.C. 154(b) by 0 days.

(21) Appl. No.: 17/006,447

(22) Filed: Aug. 28, 2020

(65) Prior Publication Data

US 2021/0065546 A1 Mar. 4, 2021

Related U.S. Application Data

(60) Provisional application No. 62/892,905, filed on Aug. 28, 2019.

(51) Int. Cl.
*G08G 1/07* (2006.01)
*G08G 1/095* (2006.01)

(52) U.S. Cl.
CPC ..... *G08G 1/095* (2013.01); *G08G 1/07* (2013.01)

(58) Field of Classification Search
CPC ..... H04W 4/02; H04W 4/024; H04W 40/06; H04W 40/10; H04W 40/20; H04W 40/248; H04W 40/30; H04W 88/04; B25J 5/007; B25J 9/1694; B60P 1/04; B60P 3/007; B66F 9/063; B66F 9/0755; G05B 19/41895; G05D 1/0225; G06Q 10/0832; G06Q 10/0833; G06Q 10/08355; G06Q 10/0837; G07B 17/00; G07C 2009/0092; A47G 2029/149; A47G 29/141; G01S 5/02; G08G 1/005; G08G 1/095; G08G 1/096716; G08G 1/096741; G08G 1/096758; G08G 1/096775; G08G 1/096791; G08G 1/087; G08G 1/01; G08G 1/081; G08G 1/09; B60K 28/066; G08B 21/06; G08C 17/02; G09F 9/00; H04L 45/00; H04L 51/38; H04Q 3/0004; Y02D 70/122; Y02D 70/142; Y02D 70/164; Y02D 70/168; Y02D 70/21; Y02D 70/24; Y02D 70/26; Y02D 70/322; Y02D 70/326; Y02D 70/38
USPC ..... 340/907, 944, 575, 909, 910, 911, 925, 340/931, 995.1, 995.13, 426.19, 691.8
See application file for complete search history.

(56) References Cited

U.S. PATENT DOCUMENTS

| | | | | |
|---|---|---|---|---|
| 7,651,242 | B1 * | 1/2010 | Guerrant | F21V 21/22 362/286 |
| 8,786,466 | B1 * | 7/2014 | Aladas | G08C 17/02 340/944 |
| 10,403,129 | B1 * | 9/2019 | Suarez | G08B 6/00 |
| 2008/0204256 | A1 * | 8/2008 | Omi | B60K 28/066 340/575 |
| 2016/0110998 | A1 * | 4/2016 | Todasco | G08G 1/005 340/944 |
| 2017/0372602 | A1 * | 12/2017 | Gilliland | G01S 17/66 |
| 2018/0116882 | A1 * | 5/2018 | Shaw | F21S 43/26 |

* cited by examiner

*Primary Examiner* — Daniel Previl
(74) *Attorney, Agent, or Firm* — The Rapacke Law Group, P.A.

(57) ABSTRACT

A wheelchair traffic signal system is disclosed, comprising at least one wheelchair traffic signal in operable communication with a controller to receive input from a user. The controller includes both a pedestrian button and a wheelchair button to selectively operate at least one wheelchair traffic signal.

18 Claims, 4 Drawing Sheets

WHEELCHAIR TRAFFIC SIGNAL SYSTEM

CROSS-REFERENCE TO RELATED APPLICATIONS

The present application claims priority to U.S. Provisional Patent Application 62/892,905 filed on Aug. 28, 2020, entitled "WHEELCHAIR TRAFFIC SIGNAL SYSTEM" the entire disclosure of which is incorporated by reference herein.

TECHNICAL FIELD

The embodiments generally relate to traffic light systems and, more specifically, relate to traffic light systems to control the movement of wheelchairs through an intersection.

BACKGROUND

Traffic lights are signaling devices positioned at road intersections, pedestrian crossings, and other locations to control flows of traffic. They operate by controlling the right of way accorded to vehicle operators by illuminating lamps or LED's of standard colors (red, yellow, and green) following a universal color code.

Many traffic lights also include pedestrian signals, which are provided in various forms including "walk," "don't walk," a walking person, a countdown timer, and a stop hand. Auditory and tactile signals are also provided for persons with physical impairments, such as those who are deaf, blind, or have impaired vision or hearing.

While pedestrian signals are effective and considered safe, they do not cater to persons with mobility disabilities, such as those persons in wheelchairs, who often experience an increased risk when crossing intersections due to lower visibility and driver awareness of the pedestrian with disabilities.

SUMMARY OF THE INVENTION

This summary is provided to introduce a variety of concepts in a simplified form that is further disclosed in the detailed description of the embodiments. This summary is not intended to identify key or essential inventive concepts of the claimed subject matter, nor is it intended for determining the scope of the claimed subject matter.

The embodiments provided herein relate to a wheelchair traffic signal system, comprising at least one wheelchair traffic signal in operable communication with a controller to receive input from a user. The controller includes a pedestrian button and a wheelchair button to selectively operate at least one wheelchair traffic signal.

The embodiments provide an additional safety element for persons with mobility disabilities, such as for persons in wheelchairs, to aid them when crossing an intersection by alerting vehicle operators that a person in a wheelchair or with another such mobility disability is expected to enter the intersection. The system is configured to be used in tandem with conventional traffic and pedestrian signals.

In one aspect, a road sign in operable communication with the controller.

In one aspect, the road sign comprises at least one wheelchair signal.

In one aspect, the wheelchair signal is attached to a traffic signal.

In one aspect, the wheelchair signal is attached to a structure configured to display the traffic signal and the wheelchair signal.

In one aspect, pressing the wheelchair button on the opposite side of an intersection causes the controller to terminate the wheelchair traffic signal.

In one aspect, a sensor array is in operable communication with the controller.

In one aspect, the sensor array is positioned throughout the intersection to determine whether a pedestrian is located in the intersection.

In one aspect, the system comprises at least one audio element and at least one visual element invoked by the warning signal. The at least one audio element and the at least one visual element are provided on the road sign and the traffic signal structure.

BRIEF DESCRIPTION OF THE DRAWINGS

A complete understanding of the present embodiments and the advantages and features thereof will be more readily understood by reference to the following detailed description when considered in conjunction with the accompanying drawings wherein.

DETAILED DESCRIPTION

Figure 1:
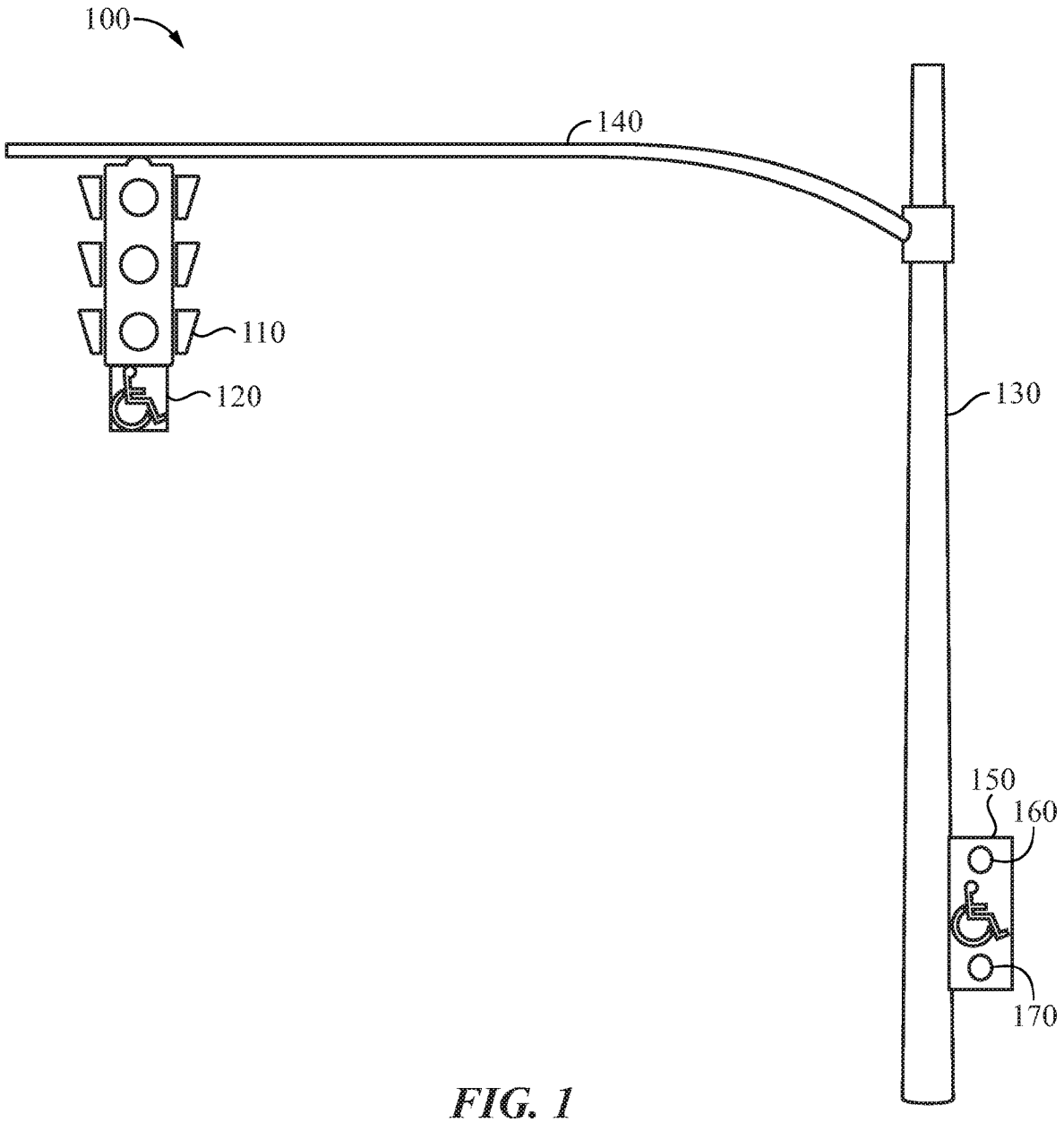
FIG. 1 illustrates a schematic of the wheelchair traffic signal system, according to some embodiments.

The specific details of the single embodiment or variety of embodiments described herein are to the described device and methods of use. Any specific details of the embodiments are used for demonstration purposes only, and no unnecessary limitations or inferences are to be understood therefrom.

Before describing in detail exemplary embodiments, it is noted that the embodiments reside primarily in combinations of components of the device and its use. Accordingly, the device components have been represented where appropriate by conventional symbols in the drawings, showing only those specific details that are pertinent to understanding the embodiments of the present disclosure so as not to obscure the disclosure with details that will be readily apparent to those of ordinary skill in the art having the benefit of the description herein.

In general, the embodiments provided herein relate to a traffic signal system adapted for use by a person with mobility disabilities, such as those persons in a wheelchair, at an intersection. The system is controlled by a push-button in operable communication with a controller. Once the push button is pressed, a signal is transmitted to a microcontroller to operate a timer, and the vehicle operators in the intersection will be presented with a red-light signal to stop traffic in the direction that affects the travel of the person in the wheelchair. The system reduces the danger to a person with a mobility disability when moving through an intersection while providing another form of safety communication between pedestrians and vehicle operators.

Figure 2:
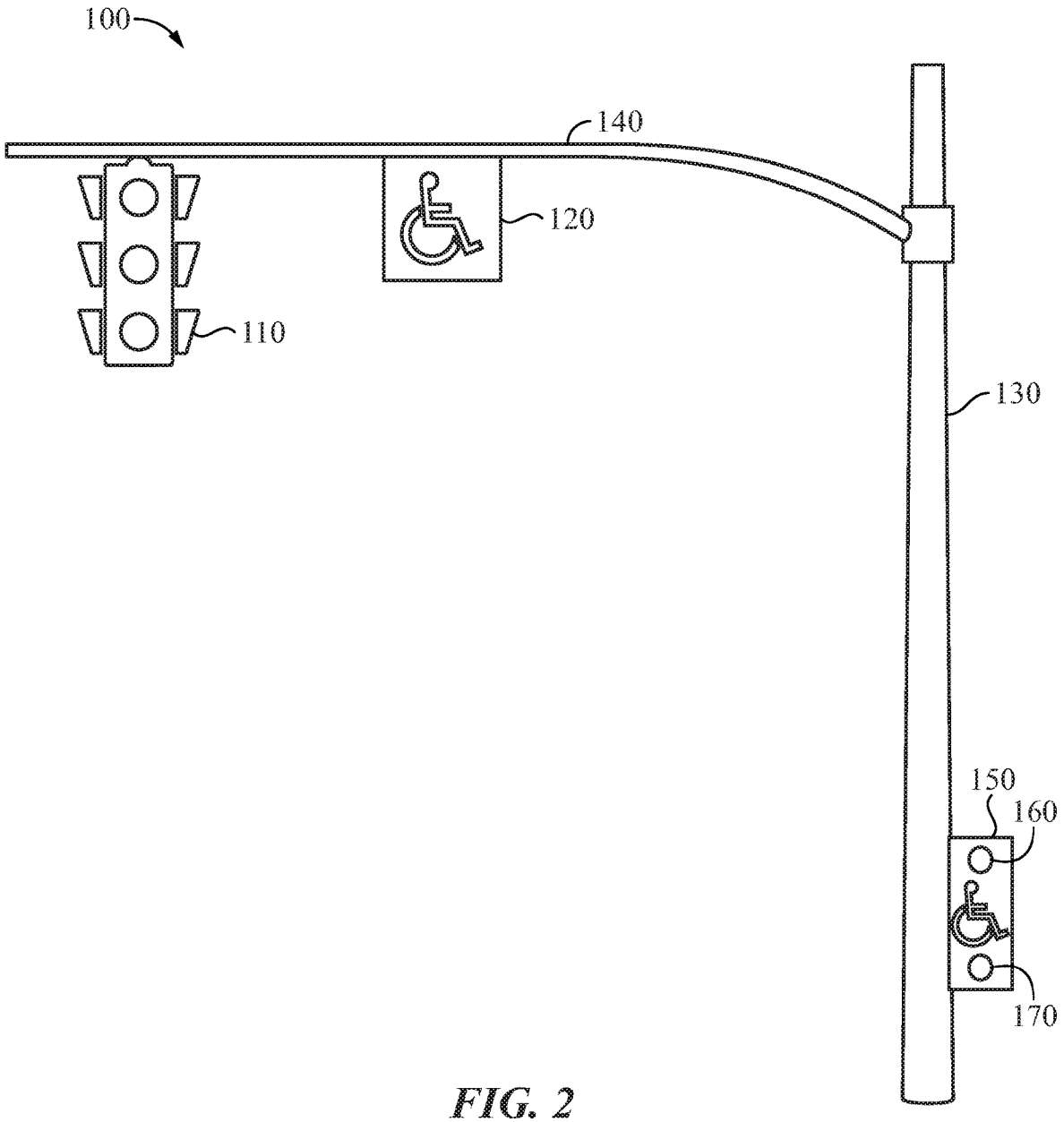
FIG. 2 illustrates a schematic of the wheelchair traffic signal system, according to some embodiments.

In reference to FIG. 1 and FIG. 2, the wheelchair traffic signal system 100 is illustrated in an exemplary embodiment comprising a traffic signal 110 and a wheelchair signal 120, which is provided in view of vehicle operators. The wheelchair signal 120 may be situated at various positions on the traffic signal structure 130, which holds the traffic signal 110. In one example, the wheelchair signal 120 is attached to the traffic signal 110 (as shown in FIG. 1). It is to be understood that the wheelchair signal 120 may be positioned above, below, or on either side of the traffic signal 110. In another example, the wheelchair signal 120 is positioned on the crossbeam 140 of the traffic signal structure 130 (as shown in FIG. 2). The wheelchair signal 120 is in operable communication with a controller 150 having a pedestrian button 160 and a wheelchair button 170. When the wheelchair button 170 is pressed, the wheelchair signal 120 is illuminated as described herein.

Figure 3:
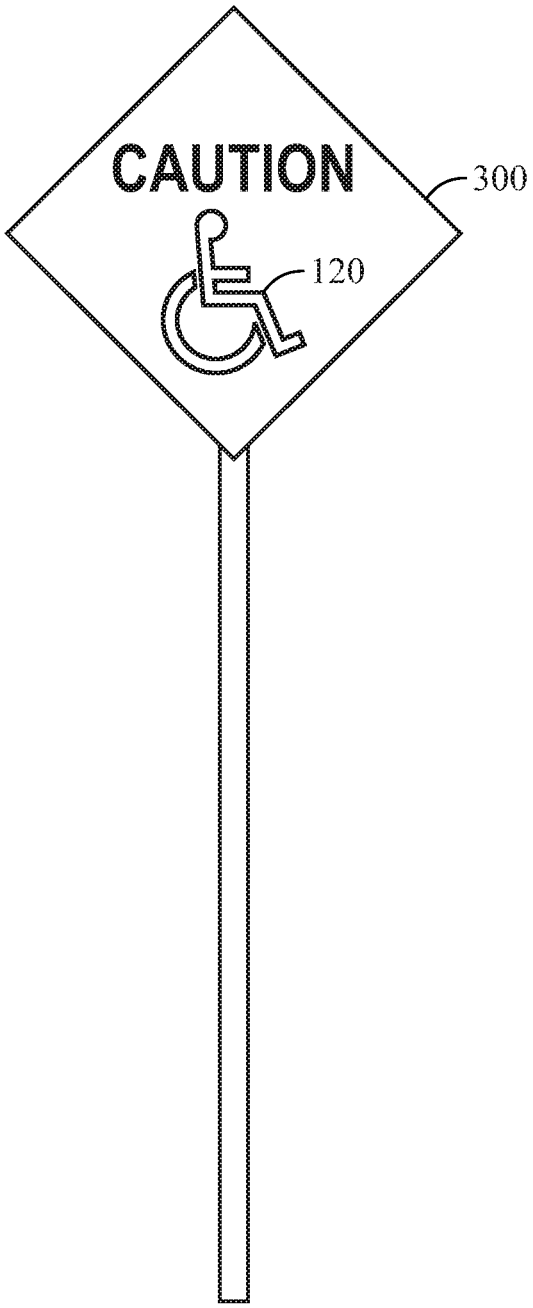
FIG. 3 illustrates a schematic of the wheelchair road sign, according to some embodiments.

In reference to FIG. 3, a road sign 300 is illustrated having the wheelchair signal 120. The road sign 300 may be positioned along the roadway and may operate along with or separately from the traffic signal 110 and wheelchair signal 120 shown in FIG. 1 and FIG. 2 and may be operated by the controller 150 when the wheelchair button 170 is pressed to notify approaching drivers that a person with a mobility disability may be crossing the intersection.

In some embodiments, the system 100 utilizes a lighting element in the configuration of the global symbol for a wheelchair. The lighting element may be programmed to flash with a configurable frequency or to be illuminated continuously.

In some embodiments, the system 100 further enables the user to terminate the wheelchair signal 120, thus permitting the traffic signal 110 to change, by pressing the wheelchair button 170 located on the other side of the intersection after the user has crossed. The controller 150 may be configured with at least one timer, the duration of which may be in part determined or overridden by the subsequent pressing of the wheelchair button 170 on the opposite side of the intersection after crossing.

In some further embodiments, the system 100 incorporates a plurality of sensors positioned within the intersection and the pedestrian walkway in operable communication with the controller 150 to determine whether a pedestrian is still in the process of crossing the intersection or if the pedestrian has cleared the intersection. In such embodiments, if the sensors detect that a pedestrian is still located within the intersection, the controller may override any existing timers and prevent the wheelchair signal 120 or the traffic signal 110 from changing until the pedestrian is safely out of the intersection.

In some embodiments, a plurality of sensors may be positioned in an environment surrounding the traffic signal 110 and traffic signal structure 130 to sense oncoming vehicles, pedestrians, and the like. The plurality of sensors may provide an output signal to the controller 150 to change the traffic signal 110 and or wheelchair signal 120.

Figure 4:
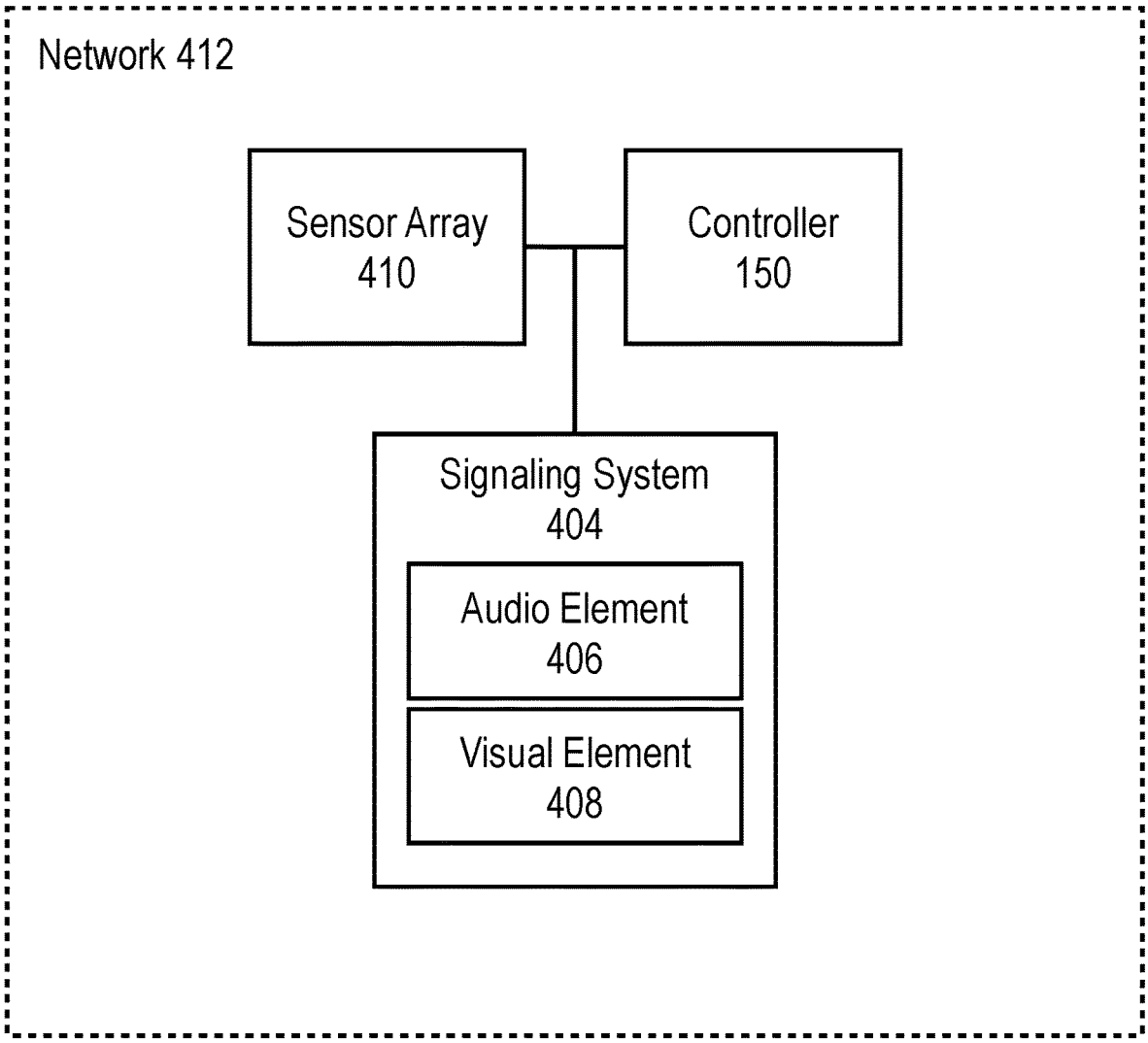
FIG. 4 illustrates a block diagram of the controller for the wheelchair traffic control system, according to some embodiments

FIG. 4 illustrates a block diagram of the controller 150 comprising a control module in operable communication with a signaling system 404. The signaling system 404 may include an audio element 406 and/or a visual element 408. For example, the audio element 406 may include one or more speakers positioned on the wheelchair signal 120 or other component of the traffic signal structure 130 and/or intersection. The visual element 408 may include a plurality of lights positioned on one or more components of the systems, such as lighting positioned on the road sign 300. A sensor array 410 may be positioned in various locations around the intersection to sense oncoming vehicles, emergency vehicles, and/or pedestrians. The network 412 may include a plurality of intersections and traffic control systems thereof, such that each traffic signal 110 and wheelchair signal 120 within a network 412 are in communication with one another.

The signaling system 404 is operable to produce a warning signal on the road sign 300, on the traffic signal 110, or on the wheelchair signal 120. The warning signal may invoke the audio element 406 and visual element 408 to produce an output, such as a warning sound and flashing lights to provide both audio and visual alerts. The warning signal may be initiated upon the depress of the pedestrian button 160 and/or the wheelchair button 170.

A network interface may be configured to allow data to be exchanged between the traffic signal 110, the wheelchair signal 120, and the controller 150, and may be attached to the network 412, such as to permit communication with other traffic signals, pedestrian signals, and/or wheelchair signals. In various embodiments, the network interface may support communication via wired or wireless general data networks, such as any suitable type of Ethernet network, for example, via telecommunications/telephony networks such as analog voice networks or digital fiber communications networks, via storage area networks such as Fiber Channel SANs, or via any other suitable type of network and/or protocol.

The outputs of the sensors in the sensor array 410 may be transmitted to a processor, which determines, in addition to the information referred to in previous examples, the number of pedestrians, if any, that are stationary at an intersection. The processor may then provide an output to automatically activate control in the form of a switching arrangement for switching the different colored lights of the traffic lights, both for vehicles and pedestrians in a wheelchair, so as to provide for safe crossing for pedestrians in a wheelchair.

Many different embodiments have been disclosed herein, in connection with the above description and the drawings. It will be understood that it would be unduly repetitious and obfuscating to describe and illustrate every combination and subcombination of these embodiments. Accordingly, all embodiments can be combined in any way and/or combination, and the present specification, including the drawings, shall be construed to constitute a complete written description of all combinations and subcombinations of the embodiments described herein, and of the manner and process of making and using them, and shall support claims to any such combination or subcombination.

An equivalent substitution of two or more elements can be made for any one of the elements in the claims below or that a single element can be substituted for two or more elements in a claim. Although elements can be described above as acting in certain combinations and even initially claimed as such, it is to be expressly understood that one or more elements from a claimed combination can in some cases be excised from the combination and that the claimed combination can be directed to a subcombination or variation of a subcombination.

It will be appreciated by persons skilled in the art that the present embodiment is not limited to what has been particularly shown and described hereinabove. A variety of modifications and variations are possible in light of the above teachings without departing from the following claims.

What is claimed is:

1. A wheelchair traffic signal system, comprising:

a traffic signal attached to a traffic signal structure at a traffic intersection; and at least one wheelchair traffic signal attached to the traffic signal structure and in operable communication with a controller on the signal structure that receives an input from a user, the controller including a pedestrian button and a wheelchair button, the wheelchair button allowing the user to selectively turn on the at least one wheelchair signal.

2. The system of claim 1, further comprising a road sign in operable communication with the controller.

3. The system of claim 2, wherein the road sign comprises the at least one wheelchair signal.

4. The system of claim 1, wherein the wheelchair signal is attached to the traffic signal.

5. The system of claim 1, wherein pressing the wheelchair button on an opposite side of the traffic intersection causes the controller to turn off the wheelchair traffic signal.

6. The system of claim 1, wherein a sensor array is in operable communication with the controller, wherein the sensor array is configured to sense one or more vehicles and one or more pedestrians.

7. The system of claim 6, wherein the sensor array is positioned in the intersection to determine whether a pedestrian is located in the intersection.

8. A wheelchair traffic signal system, comprising:

a traffic signal attached to a traffic signal structure at a traffic intersection;

at least one wheelchair traffic signal positioned on the traffic signal structure;

a controller on the traffic signal structure and in operable communication with the at least one wheelchair traffic signal, the controller configured to receive an input from a user via one of a pedestrian button and a wheelchair button, the wheelchair button allowing the user to selectively turn on the at least one wheelchair signal to display a warning signal to a plurality of vehicle operators; and a road sign to display the warning signal, wherein the warning signal is functional to output a visual element.

9. The system of claim 8, wherein the road sign comprises the at least one wheelchair signal.

10. The system of claim 8, wherein the wheelchair signal is attached to the traffic signal.

11. The system of claim 8, wherein pressing the wheelchair button on an opposite side of the traffic intersection causes the controller to turn off the wheelchair traffic signal.

12. The system of claim 8, wherein a sensor array is in operable communication with the controller.

13. The system of claim 12, wherein the sensor array is positioned throughout the intersection to determine whether a pedestrian is located in the intersection.

14. A wheelchair traffic signal system, comprising:

a traffic signal attached to a traffic signal structure at a traffic intersection;

at least one wheelchair traffic signal positioned on the traffic signal structure;

a controller on the traffic signal structure and in operable communication with the at least one wheelchair traffic signal, the controller configured to receive an input from a user via one of a pedestrian button and a wheelchair button, the wheelchair button allowing the user to selectively turn on the at least one wheelchair signal to display a warning signal to a plurality of vehicle operators;

a road sign to display the warning signal, wherein the warning signal is functional to output a visual element; and at least one audio element and at least one visual element invoked by the warning signal, wherein the at least one audio element and the at least one visual element are provided on the road sign and the traffic signal structure.

15. The system of claim 14, wherein a plurality of traffic signal structures are in communication with one another via a network.

16. The system of claim 14, wherein the road sign is positioned at a remote location from the traffic signal structure.

17. The system of claim 16, wherein a sensor array is in operable communication with the controller.

18. The system of claim 17, wherein the sensor array is positioned throughout the intersection to determine whether a pedestrian is located in the intersection.

* * * * *